US005345889A

United States Patent [19]

Gazzarrini, deceased et al.

[11] Patent Number: 5,345,889

[45] Date of Patent: Sep. 13, 1994

[54] METHOD FOR AUTOMATICALLY SEWING TWO STOCKINGS TO FORM A PANTYHOSE ARTICLE AND MACHINE TO CARRY OUT SAID METHOD

[75] Inventors: Vinicio Gazzarrini, deceased, late of Impruneta, by Alma Gazzarrini; Pier L. Migliorini, Bracciolini, both of Italy

[73] Assignee: Solis S.r.L., Florence, Italy

[21] Appl. No.: 949,387

[22] Filed: Sep. 22, 1992

[30] Foreign Application Priority Data

Sep. 23, 1991 [IT] Italy ..... FI 91 A232

[51] Int. Cl.[5] ..... D05B 97/00

[52] U.S. Cl. ..... 112/262.2; 112/121.15

[58] Field of Search ..... 112/262.1, 262.3, 260, 112/262.2, 63, 121.15, 121.12, 305, 121.26

[56] References Cited

U.S. PATENT DOCUMENTS

| | | | |
|---|---|---|---|
| 3,859,938 | 1/1975 | Fukuyama | 112/121.15 |
| 4,188,897 | 2/1980 | Takatori | 112/262.2 |
| 4,188,898 | 2/1980 | Bell, Jr. et al. | 112/121.15 X |
| 4,303,026 | 12/1981 | Ueda | 112/121.15 |
| 4,444,140 | 4/1984 | Moyer | 112/262.2 |
| 4,532,875 | 8/1985 | Gazzarrini | 112/262.2 |
| 4,541,351 | 9/1985 | Horita et al. | 112/262.2 |
| 4,862,815 | 9/1989 | Thurner et al. | 112/262.3 X |
| 5,014,634 | 5/1991 | Hodges et al. | 112/262.2 |
| 5,165,355 | 11/1992 | Fournier et al. | 112/262.2 |
| 5,207,166 | 5/1993 | Eichhorn | 112/262.2 |

FOREIGN PATENT DOCUMENTS 942878 4/1973 Italy ..... 112/121.15

*Primary Examiner*—Clifford D. Crowder
*Assistant Examiner*—Larry D. Worrell, Jr.
*Attorney, Agent, or Firm*—McGlew and Tuttle

[57] ABSTRACT

Automatically sewing two stockings to form a pantyhose article by putting the stockings on two corresponding flat, paired, juxtaposed shapes, moving the shapes close to each other with the stockings fitted thereon and cutting a longitudinal portion of the stockings, spreading apart the shapes with the cut stockings thereon and sewing the eges of the latter, rejoining the shapes and unloading the sewn pantyhose. In detail, the following operations are carried out: placing the elastic edge of the two stockings in a same preset position by seizing the elastic edge of the stocking which is located further away from the preset position and making it slide towards it, then seizing the elastic edge of the other stocking and making the two thus vertically lined up elastic edges simultaneously slide to the preset position; placing the upper part of the two stockings in a same preset position by accumulating such upper part as far as a datum line of the stockings reaches a preset position, then withdrawing it by a same preset extent; spreading the shapes apart through 180° with the stockings partially cut lengthwise thereon and sewing the edges along two straight lengths in end-to-end relationship between them: the sewing of one length being simultaneous to that of the other.

8 Claims, 7 Drawing Sheets

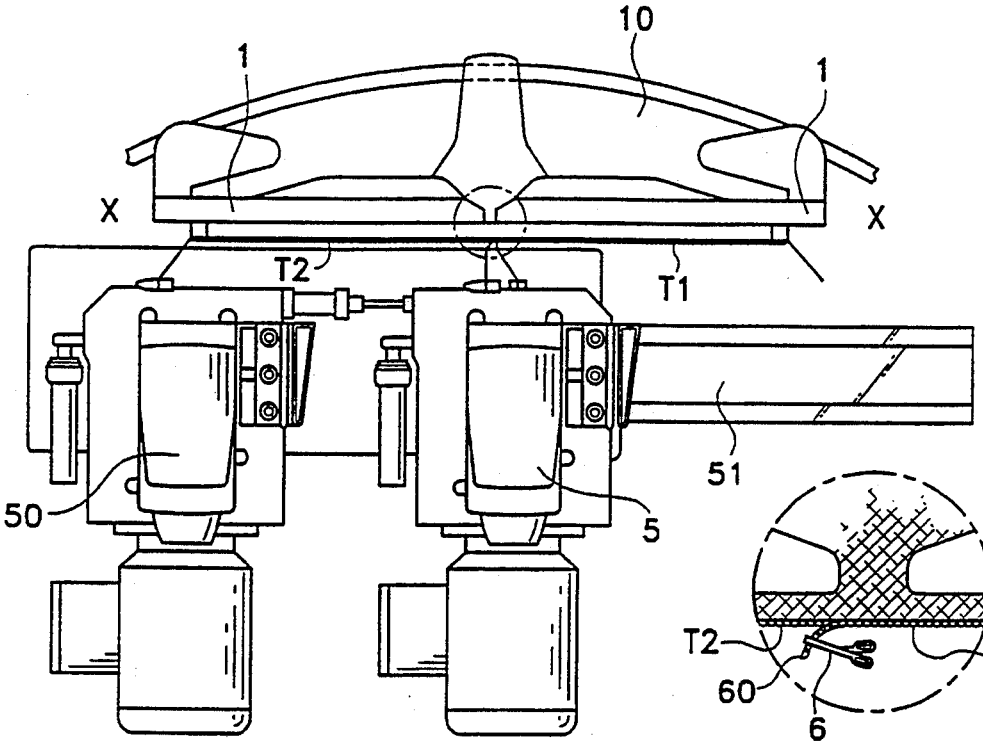
Fig. 12
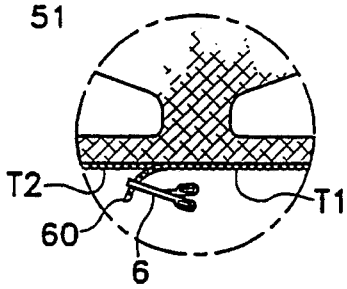
Fig. 13
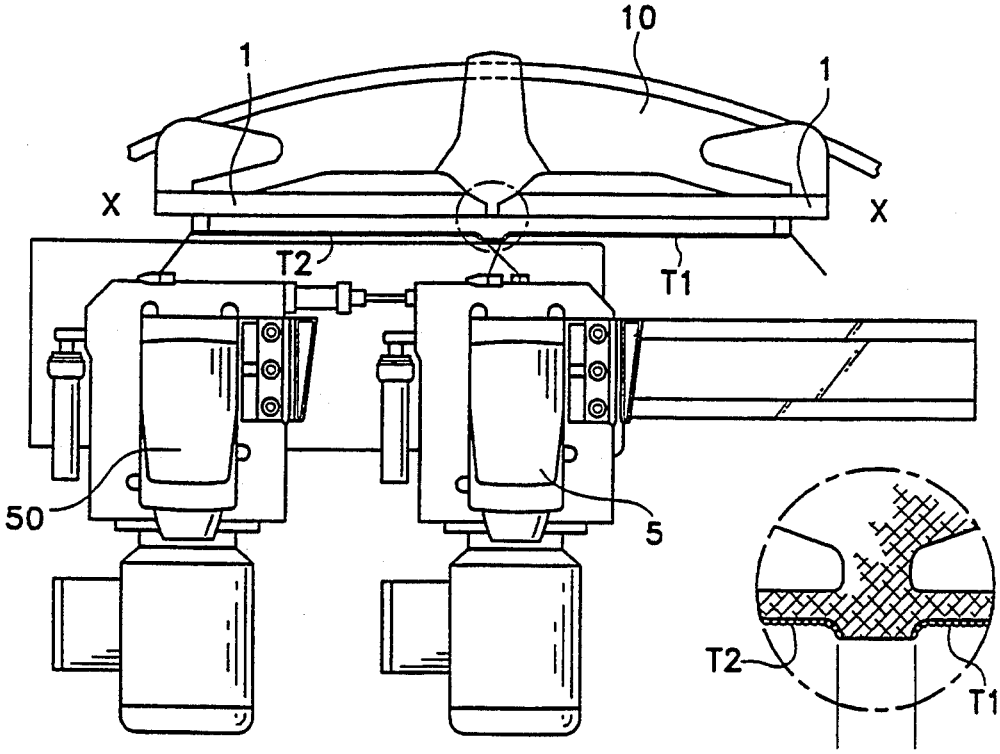
Fig. 14
Fig. 15

METHOD FOR AUTOMATICALLY SEWING TWO STOCKINGS TO FORM A PANTYHOSE ARTICLE AND MACHINE TO CARRY OUT SAID METHOD

FIELD OF THE INVENTION

The present invention describes a method and a machine for automatically sewing two stockings to form a pantyhose article.

BACKGROUND OF THE INVENTION

A process is known from patent IT 942.878 for sewing pantyhose articles which comprises putting two stockings on two corresponding flat, paired, juxtaposed shapes; moving the shapes close to each other with the stockings fitted thereon; longituinally cutting a portion of the two stockings thus kept close to each other; spreading apart the two shapes with the two stockings thus cut; sewing the two edges thus wide-opened between them; rejoining the shapes with the stockings thus sewn and making up the pantyhose article; unloading the thus obtained pantyhose. More in particular, according to the known method, there is provided to perform the sewing of the two stockings by means of only one sewing machine so that the time for making the pantyhose article is strictly dependent on the sewing time, the latter being the longest of the whole cycle.

Attempts have been made to reduce the time required for making pantyhose articles. These attempts have concentrated on increasing the working speed of the sewing machine. However a limit has presently reached and cannot be much further reduced by mechanical means.

Other improvements have been made concerning the automatic positioning of the two stockings onto the relevant shapes prior to their sewing, but not even these improvements have achieved the object of markedly reducing the pantyhose-making time.

SUMMARY AND OBJECTS OF THE PRESENT INVENTION

The main object of the present invention is of significantly reducing the time of automatic formation of pantyhose articles by utilizing machines currently available.

A further object of the invention is to release the operator in charge of the loading from duly positioning the stockings onto the shapes, by providing a means for operating rapidly and automatically, and with great accuracy, the correct positioning, that is, the vertical alignment of the elastic edge of the bodice of the two stockings prior to performing the longitudinal cut.

These results have been achieved, according to the invention, as far as the positioning of the elastic edge of the two stockings is concerned, by adopting the idea of seizing the elastic edge of one of the two stocking which is on that relevant shape further away from a preset position, making it slide towards the present position, then reaching an seizing the elastic edge of the other stocking and, finally, making the two edges slide together thus lined up to the predetermined position. As far as the positioning of the bodice of the two stockings is concerned, the present invention accumulates each stocking onto the relevant shape until the line of demarcation between the bodice whose fabric has higher density, and the leg whose fabric has less density, of the stocking reaches a predetermined position. Then the two bodices are jointly withdrawn from the two shapes to a predetermined extent. Regarding the sewing of the two stockings the present invention subdivides the sewing into two lengths and performs the sewing of the two lengths by means of two automatic sewing machines.

The advantages obtained from the present invention lie essentially in that it is possible to drastically reduce the time for producing pantyhose articles and achieve the maximum precision of execution, by lowering the time of the whole operating cycle down to less than four seconds, which represents a goal so far unaccomplished. It is possible to carry out the dual sewing by leaving the inguinal region unsewn for the application of a gusset afterwards. It is also possible to program the sewing length of each seamer and to subdivide the sewing to be performed at two separate stations by operating the sewing of the second length by starting from a point of the first length alreay sewn. Also it is possible to vertically line up the elastic edge and the bodice of the two stockings on the relevant shapes, allowing the operator to load them in bulk and thus more rapidly.

These and other advantages and characteristics of the invention will be best understood by anyone skilled in the art from a reading of the following description in conjunction with the attached drawings given as a practical exemplification of the invention, but not to be considered in a limitative sense; wherein:

BRIEF DESCRIPTION OF THE DRAWINGS

FIG. 12 shows the detail of FIG. 10 with the two seamers upon completion of a continuous sewing;

FIG. 13 shows in detail the cutting means for the residual chain [or surplus thread] of the first sewing length;

FIG. 14 shows the detail of FIG. 10 with the two seamers upon completion of an interrupted sewing;

FIG. 15 shows in larger detail the sewing interruption region;

DETAILED DESCRIPTION OF THE PREFERRED EMBODIMENT

Figure 1:
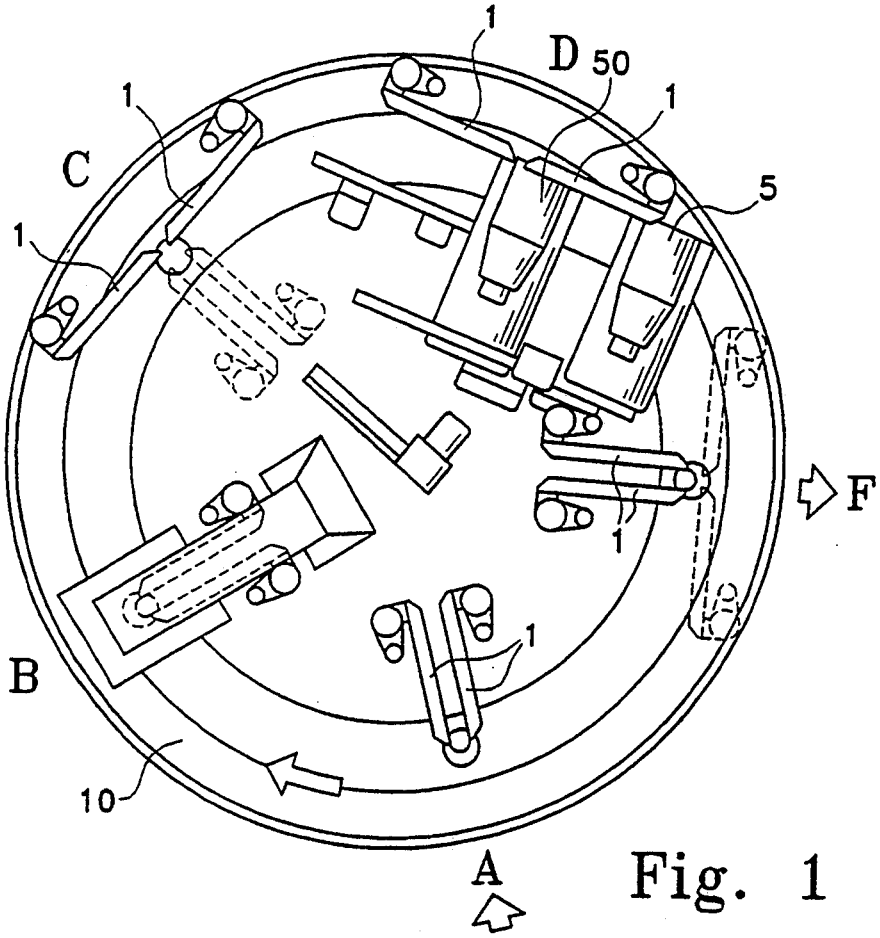
FIG. 1 shows a schematic plan view of a carrousel-type machine having a plurality of stations, for the automatic sewing in a single station, according to the invention.
Figure 2:
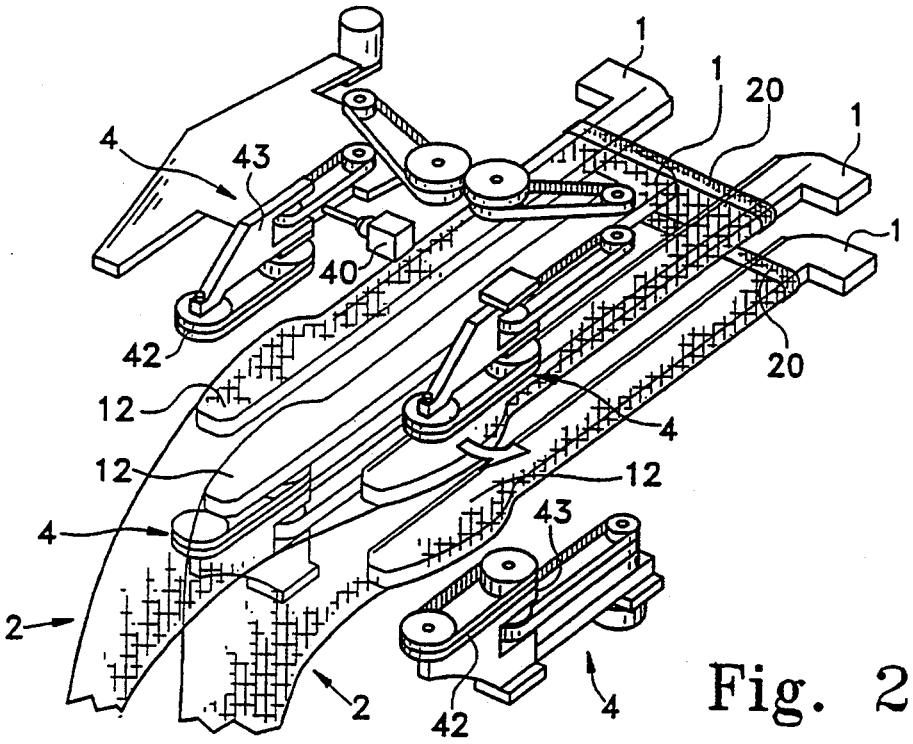
FIG. 2 is an perspective view showing in detail the means for the vertical alignment of the two stockings.

Reduced to its basic structure and with reference to the attached drawings, the method for automatically sewing two stockings to form a pantyhose article according to the invention includes manually loading a portion of the upper part of two stockings onto two sets of flat, paired, horizontal and superimposed shapes, or arms moving the shapes, with an interposed portion of the stocking between them, close to each other and clamping the shapes and the interposed portion of stocking together, cutting a longitudinal stretch of the region of the stocking thus moved close to each other, spreading the shapes apart with the thus cut stockings thereon by aligning the edges. The aligning includes:

placing, that is, vertically aligning the elastic edge of the two stockings in a predetermined position of the shapes;

placing the bodice of the two stockings in a same preset position of the shapes by observing the alignment of the elastic edges;

carrying out the longitudinal cut of an equal length of the two thus positioned bodices;

spreading the shapes apart through 180° with the stockings bodices thus cut and performing the straight sewing of the fabric edges protruding from the shapes thus spread apart;

rejoining and opening the shapes with the two thus cut stockings and unloading the pantyhose article thus obtained.

Advantageously according to the invention, the alignment of the elastic edges and the positioning of the bodice of the two stockings simultaneously, are performed at a same operative station. Also the sewing of the two bodice lengths can be performed either at a same station or at two consecutive stations.

More in particular, said vertical alignment of the two elastic edges is obtained by first operative means provided with horizontal reciprocating motion whose forward stroke is intended to detect the position of the firstly-encountered elastic edge, that is, the one of the two stockings which results at any one time loaded closer to the preset alignment position, and then reach and seize the second elastic edge, that is, the one of the stockings loaded farther away from the preset alignment position. The return stroke is intended to slidingly move forward the second elastic edge and the first elastic edge thus lined up with each other as far as the preset alignment position.

Moreover, the identical positioning of the bodice of the two stockings onto the shapes is achieved by second operative means provided with horizontal reciprocating motion. One stroke is intended to accumulate the bodice fabric onto the relevant shape, and the other stroke intended to withdrawn again the bodice over a preset length starting from the line of demarcation between the bodice and the leg of the stocking.

As far as the sewing of the two edges of the cut bodice of the two stockings is concerned, there is provided, according to the invention and in case the sewing to be carried out is continuous as preferred, that each of the two seamers will perform a corresponding sewing whose length is a little longer than half the length of the whole sewing, which implies a dual seam, of a length varying at will, in the central or inguinal region of the pantyhose.

Otherwise, in case the sewing to be carried out is discontinuous as preferred, there is provided that each of the two seamers will operate a sewing whose length is a little less that half the length of the whole sewing, which implies an interruption of the varying-at-will length in the central or inguinal region of the pantyhose.

The sewing of the two lengths by the two seamers can according to the invention—be carried out either at only one operative station and, thus, on a same article, or at two consecutive operative stations and, thus, on two distinct articles, but always at the same time.

As far as the machine for automatically sewing two stockings to form a pantyhose article according to the method of the invention, it comprises:

horizontally and intermittently rotating carrousel means 10 performing the same dwell at each operative station and provided with several pairs or sets of horizontal, paired and retractable flat shapes or arms 1 for supporting a stretched portion of pairs of juxtaposed stockings 2 manually fitted thereon in bulk;

means for the vertical alignment of the elastic edge 20 of the two stockings 2 in a preset position relative to the shapes 1, with a carriage 3 moving horizontally with reciprocating motion along the shapes 1 and provided with two optical sensors 30, one being located above and the other below the shapes 1 for the detection of the elastic edge 20 of the upper and respectively lower stocking, and with two vertically movable jaws 31, one acting from above the upper stocking and the other acting from below the lower stocking, which are driven into motion by a respective pneumatic cylinder 32 to move towards a horizontal bracket 33 solidly mounted to the carriage 3 and going into the space 11 between the shapes 1 at equal distance therefrom. The bracket acts as stationary jaw to allow for independently blocking each stocking as a consequence of the activation of each mobile jaw 31;

means for placing the bodice 22 of each stocking 2 in a same preset position on the relevant shape 1, with a first stationary optical sensor for sensing the presence of the stockings on the shapes and with two further optical sensors 41, an upper one and a lower one, for sensing the line 23 of demarcation between the bodice 22 and the leg 24 of the upper and lower stocking respectively. Two paired groups 4 for moving the stockings 2 in one direction or the other on the relevant shapes 1, each group being provided with channeled belt 42 forming a horizontal loop and mounted on an arm 43 oscillating horizontally with reciprocating motion to engage and respectively disengage the outwardly projecting end edge 12 of the corresponding shape. Each group 4 is also driven into vertical reciprocating motion to take up an inoperative condition, that is, with the belt 42 being raised/lowered with respect to the plan of the corresponding shape to be engaged, respectively, the one already in operation, that is, with the belt coplanar to the relevant shape and engaged therewith;

means for the sewing of the edges 25 of the cut and aligned bodices 22, with two sewing machines or seamers 5,50 provided at a same station of the carrousel 10, the seamers 5,50 being movable on a rail 51, parallel to the sewing direction XX, which allows them to be run in tandem thereon upon the forward or sewing (from right to left in FIG. 12) stroke and upon the return idle stroke. These seamers 5,50 being also independently movable in a direction perpendicular to the rail 51 to perform the input and output stroke respectively into and out of the sewing line XX. More specifically, there is provided, according to the invention, the possibility of performing either a continuous or a discontinuous sewing. For a continuous sewing, the first seamer 5 carries out the sewing over a first length T1 and the second seamer 50 over a second length T2. The first length T1 terminating beyond the center line of the whole seam, and the second length beginning before the center line so that the two lengths will exhibit a dual seam in correspondence of the central or inguinal region of the pantyhose. In this case, cutting means 6 are provided to cut away the tail 60 of the first sewing length T1.

For a discontinuous sewing, the first seamer 5 carries out the sewing over a first length T1 which terminates before the center line of the whole seam, and the second seamer 50 carries out the sewing over a length T2 which begins after the center line, so that the central or inguinal region of the pantyhose will result without seam: this being advantageous for the successive application of a gusset.

It goes without saying that the extent of the dual seam in case of continuous sewing, and the spacing between the two seams, in case of discontinuous sewing, can be varied at will by adjusting the active stroke of the two seamers 5,50.

Figure 16:
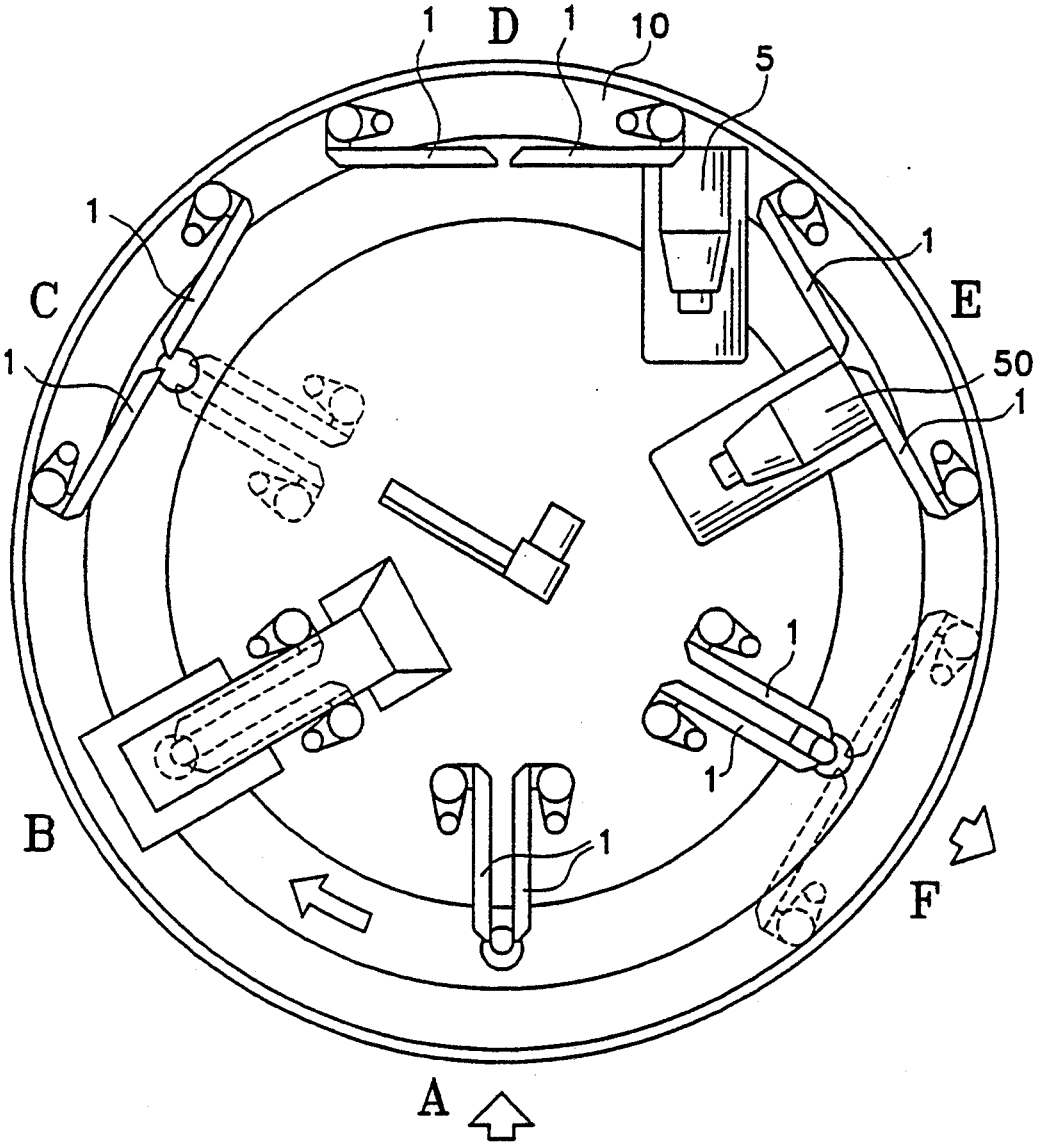
FIG. 16 is a schematic plan view of the machine of FIG. 1 for the sewing at two consecutive stations.

To facilitate the input of the second seamer 50 onto the edges to be sewn there is provided, according to the invention, for disposing the two seamers at two separate operative stations (see FIG. 16) so that only the first seamer 5 will operate in the first station to carry out the first seaming length T1 and only the second seamer 50 will operate in the next station to carry out the second seaming length T2 by moving onto the cut edges 25 already partially cut of the first seamer 5 which comes in contact with the fabric sideways.

Where the stockings to be worked are of a fabric having the same density throughout or of hardly appreciable difference of density, provision is made according to the invention of pre-inserting a mark, that is, a thread of a colour other than that of the fabric and such as to be detected by the sensors 41 and be utilized as a limit of positioning of the stocking according to the extent of sewing to be carried out.

Moreover, in place of the two optical sensors 41 positioned on the longitudinal axis of the shapes 1, provision is made according to the invention, of using two pairs of sensors 41, with one pair located above the arms of the upper shape and the other pair located below the arms of the lower shape: to each of the four sensors 41 a handling group 4 being associated to activate the relevant belt 42 even separately from the belts 42 of the other groups 4. This brings about the advantage of causing the line of demarcation 23 of each stocking to take up a disposition which is always perpendicular to the axis of the relevant shape.

Figure 3:
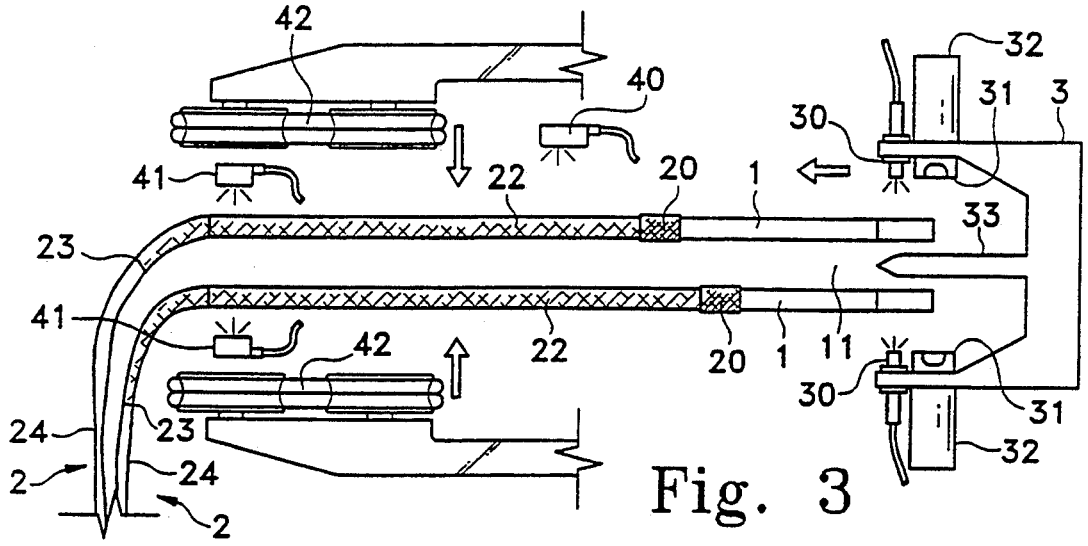
FIG. 3 shows a longitudinal section of the detail of FIG. 2 with the stockings in a possible initial position of manual loading.
Figure 4:
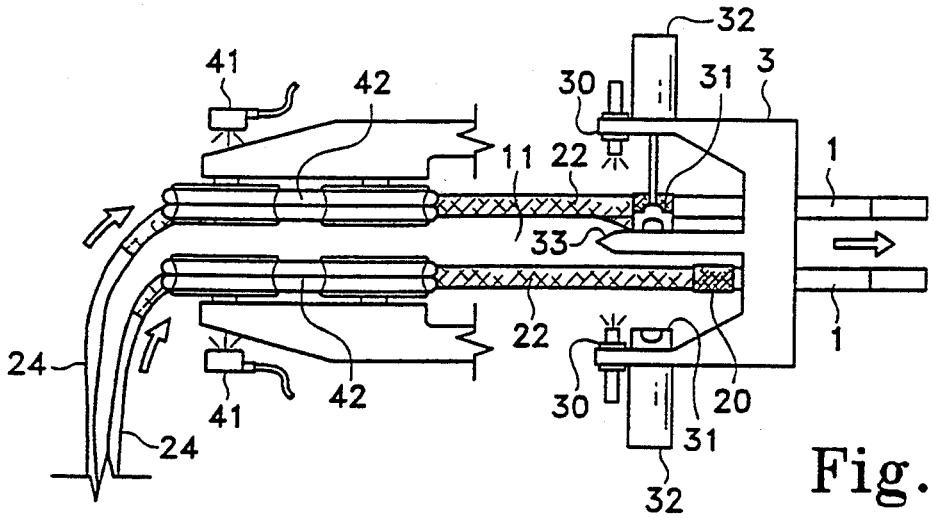
FIG. 4 shows the detail of FIG. 3 with the means for the alignment of the elastic edge being engaged with one stocking, and with the means for the alignment of the bodice of the two stockings during the accumulation thereof on the shapes.
Figure 5:
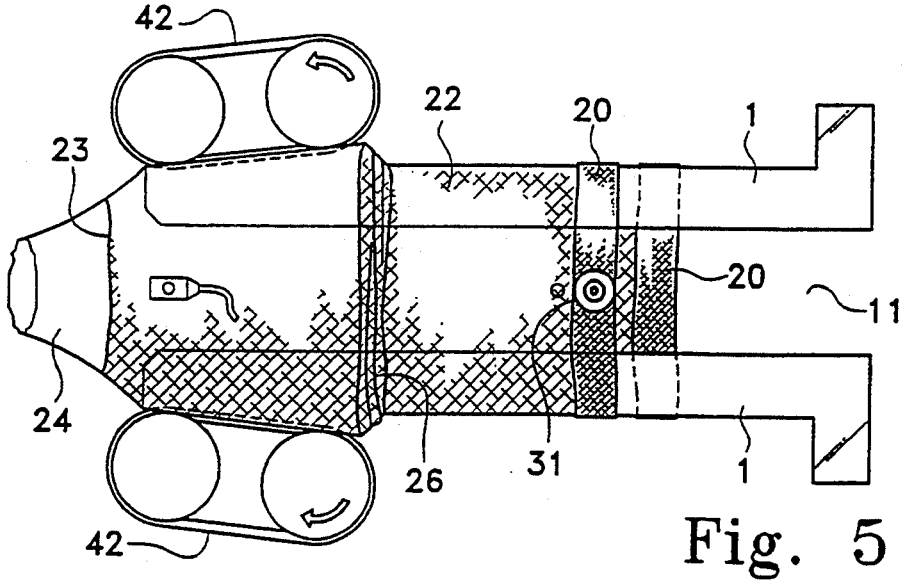
FIG. 5 shows a plan view of the detail of FIG. 4.
Figure 6:
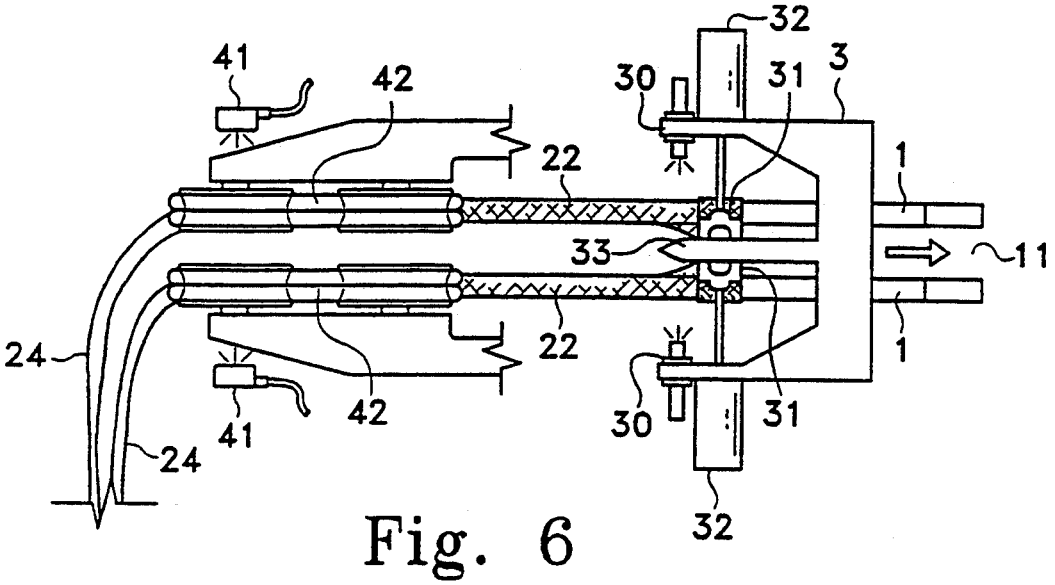
FIG. 6 shows the detail of FIG. 3 with the means for the alignment of the elastic edges being engaged with both the stockings, and with the means for the alignment of the bodice being disengaged.
Figure 7:
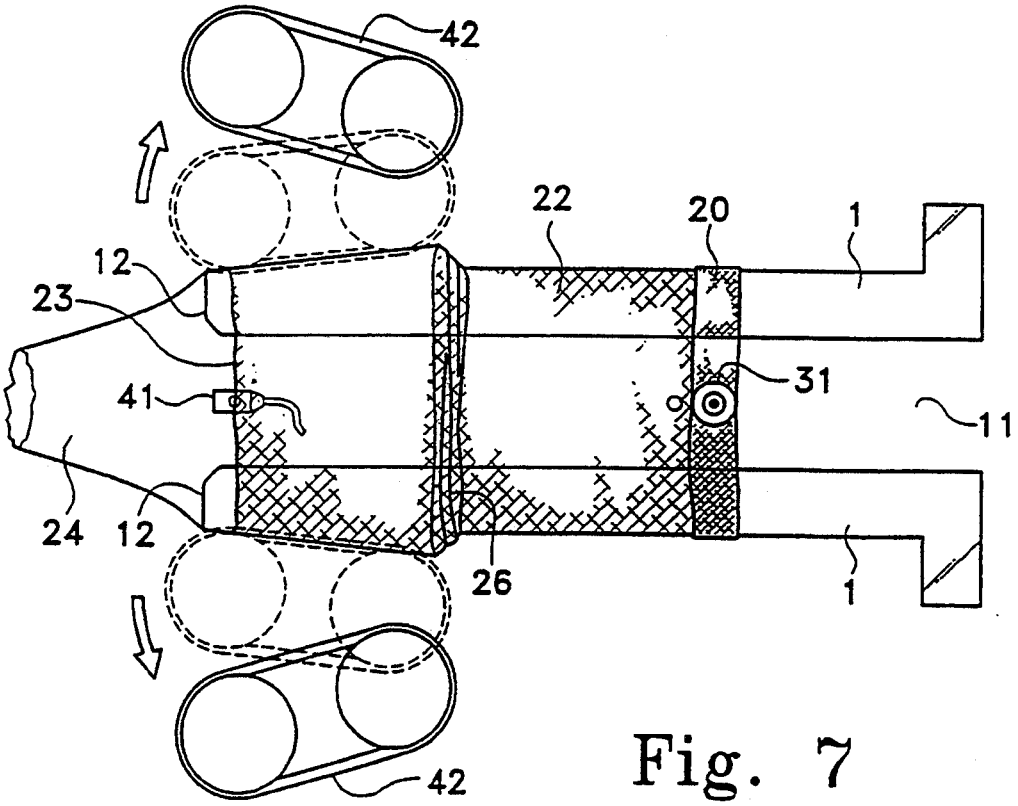
FIG. 7 shows a plan view of the detail of FIG. 6.
Figure 8:
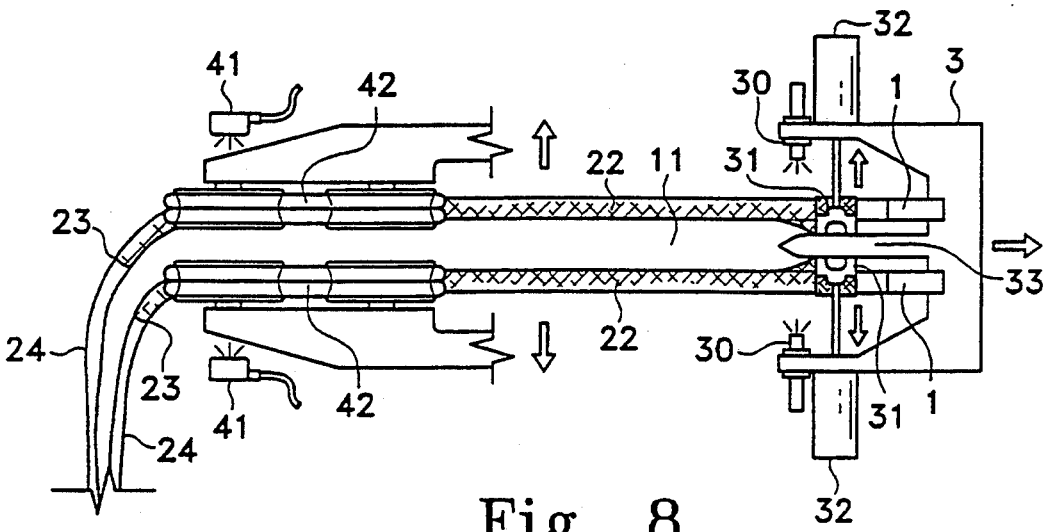
FIG. 8 shows the detail of FIG. 3 with the elastic edges completely aligned vertically and with the means for the alignment of the bodices in the condition of alignment completion.
Figure 9:
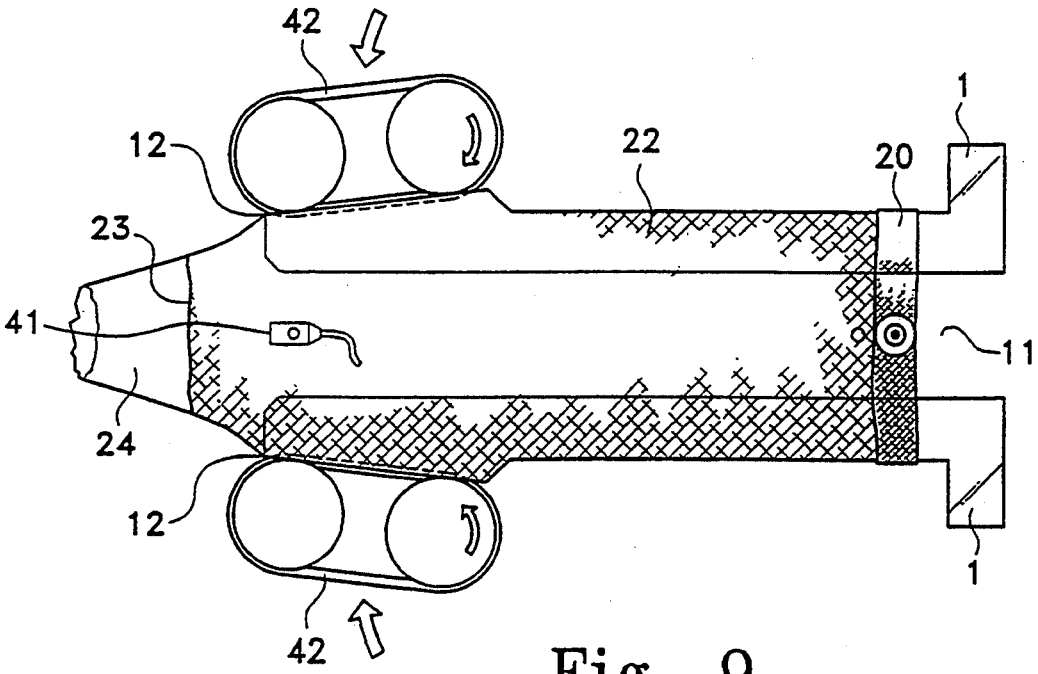
FIG. 9 shows a plan view of the detail of FIG. 8.
Figure 10:
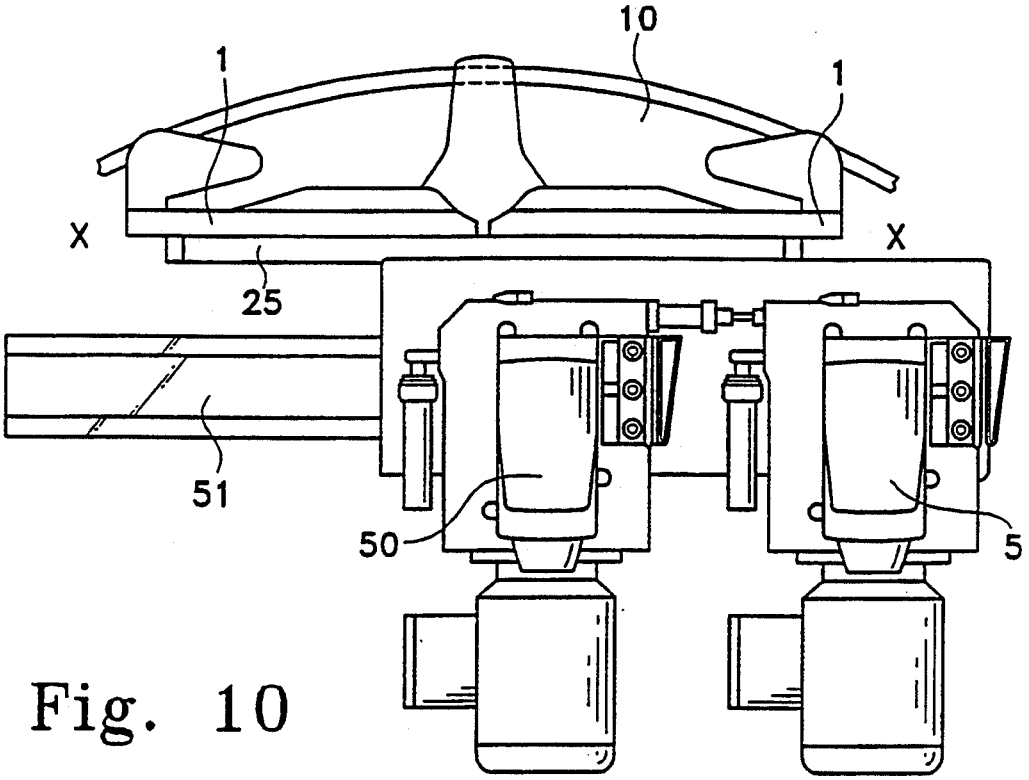
FIG. 10 is a plan view showing in detail the sewing station with the two seamers prior to the sewing.
Figure 11:
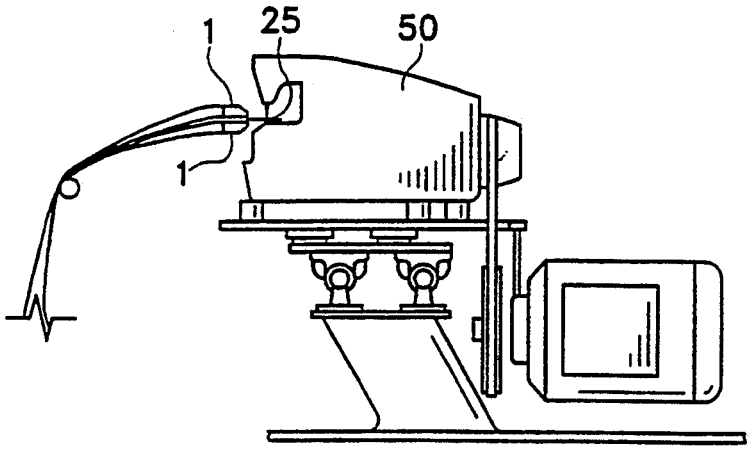
FIG. 11 shows a simplified side view of the detail of FIG. 10.

The operation is as follows. An operator provides—in the station A of carrousel 10—for inserting manually and in bluk two stockings on the two shapes 1; the shapes dwell, owing to the clockwise one-step rotation of the carrousel, in the next station B where the two stockings have their elastic edges lined up and their bodices positioned as set forth in the following. The carriage 3, upon its forward (to the left in FIG. 3) stroke detects allows the lower sensor 30 to sense the elastic edge 20 of the closer stocking (that is, the underlying one in FIG. 3) but it continues its travel until the upper sensor 30 intercepts the elastic edge 20 of the stocking which is further away and comes to a halt. The upper jaw 31 is activated for blocking the upper stocking by the bracket 33. Thereafter, the carriage moves back and, as soon as it reaches the detected position of the elastic edge of the underlying stocking, the lower jaw 31 which blocks the lower stocking through the bracket 33, is activated. Then, the carriage continues its return travel with the two lined up edges 20 up to the predetermined alignment position.

At the same time, as soon as each sensor 41 has intercepted the bodice 22 of the corresponding stocking, the belt 42 of the relevant paired group 4, which belt is in contact with the edge 12 of the corresponding shape 1 with the relevant stocking interposed therebetween, is activated in such a direction as to insert the stocking over the shape and thus causing the stocking to form an accumulation 26 of material which builds up until the sensor 41 of each stocking, after intercepting the line 23 of demarcation between the bodice 22 and the leg 24 of the stocking, operates the detachment of the belt 42 from the shape and the stopping thereof. As soon as the two stockings lines 23 have been intercepted, the four belts 42 are moved again close to the shapes and activated in the opposite direction, that is, in a direction of withdrawal of the stockings from the shapes, thereby causing the lines 23 to move by a predetermined, although varying at will, extent so as to finally result vertically lined up at a preset position relative to the shapes 1.

In case a stocking is loaded on the relevant shape so that the line 23 is on the shape and thus in a position undetectable by a sensor 41, the latter will operate the corresponding belt 42 so as to have the stocking withdrawn from the shape by an extent sufficient for the said line 23 to be intercepted by the sensor 41. After that, the belt will draw out the stocking by the established extent to bring the line 23 to the predetermined alignment position.

With the further one-step advancement of carrousel 10, the shapes 1 with the thus positioned stockings, dwell at station C where the longitidinal cut of a bodice portion is operated. Then, after another step of carrousel 10, the shapes 1 dwell at the sewing station D. If this station is provided with the two seamers 5,50 (see FIG. 13), these are made to advance by a corresponding pneumatic cylinder 55, up to the cut fabric edges 25 to be sewn, so that the first seamer 5 will come in contact sideways with the fabric and from top with the edges, while the second seamer 50 will enter frontally and a little before or, respectively, a little after the center line of the completed seam, according whether a continuous or, respectively, discontinuous sewing is to be performed. During the sewing, the two seamers are made to advance concordantly in tandem on the rail 31 by known per se means. Upon completion of the sewing, the two seamers are caused to move backwards, that is, to leave the edges being cut, and thus brought back to the starting point on the rail 51.

When the two seamers 5,50 are provided at two separate stations D of carrousel 10 (see FIG. 16), the first seamer 5 carries out the sewing of the first length T1 of a pantyhose article, and the second seamer 50 carries out the sewing of the second length T2 of another pantyhose article at the same time.

In both cases, the whole sewing of the pantyhose is accomplished in a time approximately half the one so far taken by the known pantyhose-sewing machines.

Practically, all the construction details may vary in any equivalent way as far as the form, dimensions, elements disposition, nature of the used materials are concerned, without nevertheless departing from the scope of the adopted solution idea and, thereby, remaining within the limits of the protection granted to the present patent for industrial invention.

I claim:

1. A method for forming a pantyhose article, the method comprising the steps of:

providing a carriage;

providing first and second pairs of shapes with an elastic edge position on each of said first and second pairs of shapes;

providing a first stocking with an elastic edge;

providing a second stocking with an elastic edge;

sliding a first stocking over a first pair of shapes;

sliding a second stocking over a second pair of shapes;

moving said carriage from said elastic edge position to said elastic edge of one of said first and second stockings furthest away from said elastic edge position;

attaching said carriage to said furthest stocking from said elastic edge position;

moving said carriage attached to said furthest stocking to one of said stockings nearest said elastic edge position;

attaching said carriage to said nearest stocking to said elastic edge position;

moving said carriage attached to said furthest and nearest stockings to said elastic edge position;

providing a datum line on said first and second stockings;

providing a datum position on each of said first and second pairs of shapes;

accumulating said first and second stockings on said first and second pairs of shapes until said datum line of said first and second stockings is aligned with said datum position;

clamping one shape of each of said first and second pairs of shapes and an interposed portion of said first and second stockings together in order to form adjacent portions of said first and second stockings;

cutting said adjacent portions of said first and second stockings to form cut edges on each of said first and second stockings;

spreading apart each shape of said first and second pair of shapes with respect to each other to form first and second sets of cut edges, said first set of cut edges having a cut edge from said first stocking and a cut edge from said second stocking, said second set of cut edges having another cut edge from said first stocking and another cut edge from said second stocking;

substantially simultaneously sewing a first set of said cut edges together while also sewing a second set of said cut edges together.

2. A method according to claim 1, further comprising:

providing said first and second stockings with a bodice and a leg portion, and placing said datum line at a connection between said bodice and said leg portion;

withdrawing said first and second stockings a predetermined amount from said first and second shapes after said step of accumulating and before said step of cutting;

withdrawing said sewn together stockings from said first and second arms;

said spreading of each pair of said first and second pairs of shapes is approximately 180 degrees with respect to each other.

3. A method according to claim 1, further comprising:

inserting a colored thread into said first and second stockings for said providing of said datum line.

4. A method according to claim 2, further comprising:

varying said predetermined amount of withdrawing of said first and second stocking after said accumulating in relation to a depth of said cutting of said first and second stockings.

5. A method according to claim 1, wherein:

said sewing of said first and second sets forms a continuous seam along said cut edges with a dual seam at a central region, a length of said dual seam being variable.

6. A method according to claim 1, wherein:

said sewing of said first and second sets forms two separate seams along said cut edges, said two separate seams being spaced apart at a central region, a length of said spaced apart being variable.

7. A method according to claim 1, wherein:

a length of said first and second sewn sets is substantially similar.

8. A method according to claim 1, further comprising:

sliding a third stocking over a third pair of shapes;

sliding a fourth stocking over a fourth pair of shapes;

clamping one shape of each of said third and fourth pairs of shapes and an interposed portion of said third and fourth stockings together;

cutting adjacent portions of said third and fourth stockings to form cut edges on each of said third and fourth stockings;

spreading apart each shape of said third and fourth pair of shapes with respect to each other;

said substantially simultaneously sewing together of said first set of said cut edges being of said first and second stockings, while said sewing together of said a second set of said cut edges being of said third and fourth stockings.

* * * * *